US008353676B2

(12) United States Patent
Kallesøe

(10) Patent No.: US 8,353,676 B2
(45) Date of Patent: Jan. 15, 2013

(54) METHOD FOR DETERMINING FAULTS DURING THE OPERATION OF A PUMP UNIT

(75) Inventor: Carsten S. Kallesøe, Viborg (DK)

(73) Assignee: Grundfos a/s, Bjerringbro (DK)

( * ) Notice: Subject to any disclaimer, the term of this patent is extended or adjusted under 35 U.S.C. 154(b) by 0 days.

(21) Appl. No.: 13/284,049

(22) Filed: Oct. 28, 2011

(65) Prior Publication Data

US 2012/0101788 A1 Apr. 26, 2012

(30) Foreign Application Priority Data

Feb. 11, 2004 (EP) ..... 04 002 979

(51) Int. Cl.
*F04B 49/00* (2006.01)

(52) U.S. Cl. ..... 417/18

(58) Field of Classification Search ..... 417/1, 18, 417/19, 20, 22, 32, 42, 43, 44.2, 44.3, 44.11
See application file for complete search history.

(56) References Cited

U.S. PATENT DOCUMENTS

2003/0091443 A1 * 5/2003 Sabini et al. ..... 417/53

FOREIGN PATENT DOCUMENTS

WO WO0172352 * 10/2001

* cited by examiner

*Primary Examiner* — Devon Kramer
*Assistant Examiner* — Bryan Lettman
(74) *Attorney, Agent, or Firm* — McGlew and Tuttle, P.C.

(57) ABSTRACT

A method for determining faults during the operation of a pump unit. At least two electric variables that determine the electric output of the motor and at least one fluctuating hydraulic variable of the pump are detected. The detected values or values formed from the variables by use of algorithms are automatically compared to predefined stored values using electronic data processing and the results of the comparison are used to determine whether or not faults have occurred.

15 Claims, 8 Drawing Sheets

METHOD FOR DETERMINING FAULTS DURING THE OPERATION OF A PUMP UNIT

CROSS REFERENCE TO RELATED APPLICATION

This is a continuation of U.S. application Ser. No. 10/597,892, which is a United States National Phase application of International Application PCT/EP2005/001193, which designated inter alia the United States and which claims the priority of European Application EP 04002979.5 of Feb. 11, 2004. The entire contents of each application is hereby incorporated by reference in its entirety.

FIELD OF THE INVENTION

The invention relates to a method for determining faults on operation of a pump assembly, in particular of a centrifugal pump assembly.

BACKGROUND OF THE INVENTION

In the meanwhile, it is counted as belonging to the state of the art to provide a multitude of sensor systems with pump assemblies, on the one hand to detect operating conditions, and on the other hand to also determine faulty conditions of the installation and/or of the pump assembly. With this, it is disadvantageous that the sensor system required with regard to this, is not only complicated and expensive, but is often also susceptible to faults.

SUMMARY OF THE INVENTION

Against this background, it is an object of the invention, to provide a method for determining faults on operation of a pump assembly which may be carried out with as little as possible sensor technology, as well as a device for carrying out the method.

According to the invention, the method is provided for determining faults on operation of a pump assembly, with which at least two electrical variables of the motor which determine the electrical power of the motor, and at least one changing hydraulic variable of the pump, as well as at least one further mechanical or hydraulic variable which determines the power of the pump, are acquired. The two electrical variables of the motor which determine the electrical power of the motor, are mathematically linked for achieving at least one comparison value. The at least one changing hydraulic variable of the pump, as well as at least one further mechanical or hydraulic variable determining the power of the pump are mathematically linked for achieving at least one comparison value. A mathematical, electrical motor model is used in combination with a mathematical, mechanical-hydraulic pump model/motor model for the mathematical linking, and one determines whether a fault is pre-sent or not by way of the results of the mathematical linkings by comparison with predefined values.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
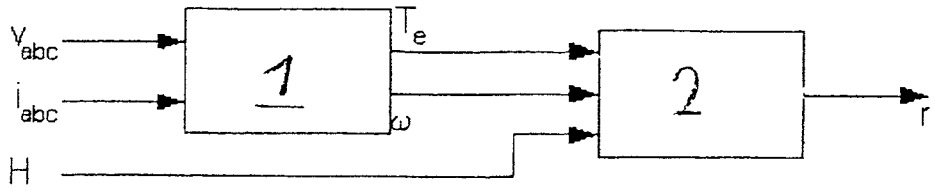
FIG. 1 is a schematic view of a first method embodiment according to the invention.

The basic concept of the invention is to acquire data characteristics of the electrical motor as well as the hydraulic-mechanical pump by way of electrical variables of the motor, which as a rule are available anyway or at least may be determined with little effort, as well as by way of at least one changing hydraulic variable of the pump which as a rule is to be determined by sensor, and to evaluate this characteristic data, as the case may be, after mathematical operations (linking)

In the simplest form, this is effected by way of comparison to predefined values, wherein the comparison as well as the result is effected automatically by way of electronic data processing, which thus ascertains whether a fault is present or not on operation of the pump.

The method according to the invention, for determining faults on operation of a pump assembly, thus envisages at least two variables determining the electrical power of the motor, and at least one changing hydraulic variable of the pump being detected, and these detected values or values derived therefrom being compared to predefined values, and determining whether a fault is present or not. This is all effected automatically by way of electronic data processing. The method according to the invention requires a minimum of sensor technology and as a rule may be implemented with regard to software with modern pumps which are typically controlled by a frequency converter and have a digital data processing in any case. Thereby, it is particularly advantageous that the variables determining the electrical power of the motor, specifically typically the voltage prevailing at the motor, and the current feeding the motor are available in any case within the frequency converter electronics, so that for determining a hydraulic variable, e.g. the pressure, only a pressure sensor is required, which moreover is already often counted as belonging to standard equipment with modern pumps. The predefined values required for the comparison may be stored in digital form in suitable memory components of the motor electronics.

Alternatively to the comparison with characteristic values of the motor and pump stored in a tabular form, according to a further aspect of the invention, it is envisaged on the one hand for the two electrical variables of the motor determining the electronic power of the motor, preferably the voltage prevailing at the motor and the current feeding the motor, to be mathematically linked for achieving at least one comparison value, and on the other hand for the at least one changing hydraulic variable of the pump as well as a further mechanical or hydraulic variable determining the power of the pump to be mathematically linked for achieving at least one further comparison value, wherein then one determines whether a fault is present or not by way of the result of the mathematical linking by way of comparison with predefined values. The mathematical linking thereby is effected for the data on the part of the motor by way of suitable equations determining the electrical and/or magnetic relations in the pump, whereas equations which describe the hydraulic and/or mechanical system are used for the pump. The values resulting with the respective linking are compared either directly or to predefined values stored in the memory electronics, whereupon the electrical data processing automatically ascertains whether an error is present or not. With the direct comparison, the error variable is determined as a variation between a variable resulting from the motor model e.g. $T_e$ or ω and a corresponding variable resulting from the mechanical-hydraulic model. The method according to an aspect of the invention in contrast, has the advantage that less memory space is required for the predefined values, but however this method requires more computation capability of the computer.

Thereby, with the method according to the invention, one may not only ascertain whether a fault is present, but moreover one may also yet specify the faults, i.e. determine as to which faults are present.

Advantageously, the pressure or differential pressure produced by the pump is used as a hydraulic variable to be detected, since this variable may be detected on the part of the assembly, and the provision of such a pressure recorder is nowadays counted as belonging to the state of the art with numerous pump construction types.

Alternatively or additionally to detecting the pressure, it may also be advantageous to use the quantity delivered by the pump as a hydraulic variable. The detection of the delivery quantity may likewise be effected on part of the assembly, and here too, less complicated measurement systems which are stable over the longer term are available.

Since the absolute pressure detection of the pressure produced by the pump always represents a differential pressure measurement with respect to the outer atmosphere, it is often more favorable to detect the differential pressure formed between the suction side and the pressure side of the pump, instead of the absolute pressure, which furthermore as a hydraulic variable of the pump is processed in a significantly more favorable manner.

Advantageously, one uses a mechanical-hydraulic pump/motor model for the mathematical linking for the variables determining the electrical power of the motor and for the mathematical linking of the mechanical-hydraulic pump variable. Thereby, as an electrical motor model, it is preferred to use one defined by the equations (1) to (5) or (6) to (9) or (10) to (14).

$$L_s' \frac{di_{sd}}{dt} = -R_s' i_{sd} + \frac{L_m}{L_r}(R_r'\psi_{rd} + z_p\omega\psi_{rq}) + v_{sd} \tag{1}$$

$$L_s' \frac{di_{sq}}{dt} = -R_s' i_{sq} + \frac{L_m}{L_r}(R_r'\psi_{rq} - z_p\omega\psi_{rd}) + v_{sq} \tag{2}$$

$$\frac{d\psi_{rd}}{dt} = -R_r'\psi_{rd} - z_p\omega\psi_{rq} + R_r' L_m i_{sd} \tag{3}$$

$$\frac{d\psi_{rq}}{dt} = -R_r'\psi_{rq} + z_p\omega\psi_{rd} + R_r' L_m i_{sq} \tag{4}$$

-continued $$T_e = z_p \frac{3}{2}\frac{L_m}{L_y}(\psi_{rd} i_{sq} - \psi_{rq} i_{sd}) \tag{5}$$

The equations (1) to (5) represent an electrical, dynamic motor model for an asynchronous motor.

$$V_s - Z_s(s) I_s \tag{6}$$

$$\omega = \omega_s - s\omega_s \tag{7}$$

$$I_r = \frac{V_a}{Z_r(s)} \tag{8}$$

$$T_e = \frac{3R_r I_r^2}{s} \tag{9}$$

The equations (6) to (9) represent an electrical, static motor model likewise for an asynchronous motor.

$$L_s \frac{di_{sd}}{dt} = -R_s i_{sd} + z_p\omega L_s\psi_{rq} + v_{sd} \tag{10}$$

$$L_s \frac{di_{sq}}{dt} = -R_s i_{sq} - z_p\omega L_s\psi_{rd} + v_{sq} \tag{11}$$

$$\frac{d\psi_{rd}}{dt} = -z_p\omega\psi_{rq} \tag{12}$$

$$\frac{d\psi_{rq}}{dt} = z_p\omega\psi_{rd} \tag{13}$$

$$T_e = z_p \frac{3}{2}(\psi_{rd} i_{sq} - \psi_{rq} i_{sd}) \tag{14}$$

The equations (10) to (14) represent an electrical dynamic motor model, and specifically for a permanent magnet motor.

In the equations (1) to (14) are represented:

$i_{sd}$ is a motor current in a direction d $i_{sq}$ is a motor current in a direction q $\psi_{rd}$ is a magnetic flux of the rotor of the pump motor in the d-direction $\psi_{rq}$ is a magnetic flux of the rotor of the pump motor in the q-direction $T_e$ is a motor moment $v_{sd}$ is a supply voltage of the motor in the d-direction $v_{sq}$ is a supply voltage of the motor in the q-direction ω is an angular speed of the rotor and an impeller or the actual rotor and impeller rotational speed $R'_s$ is an equivalent resistance of a stator winding of an asynchronous motor $R'_r$ is an equivalent resistance of the rotor winding of the asynchronous motor $L_m$ is an inductive coupling resistance between the stator winding and the rotor winding $L'_s$ is an inductive equivalent resistance of the stator winding $L_r$ is an inductive equivalent resistance of the rotor winding $z_p$ is a polar number $I_s$ is a phase current $V_s$ is a phase voltage $\omega_s$ is a frequency of the supply voltage s the motor slip $Z_s(s)$ is the stator impedance $Z_r(s)$ is the rotor impedance $R_r$ is the equivalent resistance of the rotor winding of a permanent magnet motor $R_s$ is the equivalent resistance of the stator winding of the permanent magnet motor $L_s$ is the inductive resistance of the stator winding wherein d and q are two directions perpendicular to the motor shaft and perpendicular to one another and wherein the mechanical-hydraulic pump/motor model is formed by the equation The equation (15) and at least one of the equations (16) and (17) are advantageously applied for the mechanical-hydraulic pump/motor model.

Thereby, the equation (15) represents the mechanical relationships between the motor and the pump, whereas the equations (16) and (17) describe the mechanical-hydraulic relationships in the pump.

These equations are:

$$J\frac{d\omega}{dt} = T_e - B\omega - T_P \tag{15}$$

and at least one of the equations $$H_p = -a_{h2}Q^2 + a_{h1}Q\omega + a_{h0}\omega^2 \tag{16}$$

$$T_p = -a_{t2}Q^2 + a_{t1}Q\omega + a_{t0}\omega^2 \tag{17}$$

in which $$\frac{d\omega}{dt}$$

the temporal derivative of the angular speed of the rotor, $T_p$ the pump torque, J the moment of inertia of the rotor, impeller and the delivery fluid contained in the impeller, B the friction constant, Q the delivery flow of the pump, $H_p$ the differential pressure produced by the pump, $a_{h2}$, $a_{h1}$, the parameters which describe the relationship between the rotational speed of the $a_{h0}$ impeller, the delivery flow and the differential pressure and $a_{t2}$, $a_{t1}$, the parameters which describe the relation between the rotational speed of the $a_{t0}$ impeller, the delivery flow and the moment of inertia.

By way of example, defines in which manner the mathematical linking is carried out, in order to determine whether faults are present or not. In principle, one may here completely make do without storing predefined values. The basic concept of this specific method lies on the one hand, with the aid of the motor model, in determining the motor moment resulting on account of the electrical variables at the variables at the motor shaft, as well as the rotational speed, wherein the latter may also be measured. A relation between the pressure and delivery quantity on the one hand or between the power/moment and the delivery quantity on the other hand is determined with the help of the equations (16) and/or (17). Then, advantageously with equation (15), one checks as to whether the variables computed with the help of the motor model agree or not to those variables computed with the help of the pump model after substitution with the measured hydraulic variable, wherein a fault is registered should they not agree. One therefore quasi compares, whether the drive variables resulting from the electrical motor model agree or not with those drive variables resulting from the hydraulic-mechanical pump model. If this is the case, the pump assembly functions without faults, otherwise a fault is present which as the case may be, may be yet specified further.

In order to provide the system with a certain amount of tolerance, it may be useful, by way of variance of at least one of the variables $a_{h0}$ to $a_{h2}$, $a_{t0}$ to $a_{t2}$, B and J define a tolerance range, in order then to only register a fault when this is also relevant to operation.

In order to be able to specify the type of fault in a more accurate manner, it is useful additionally to the two electrical variables, to determine two hydraulic variables, preferably by way of measurement, and to substitute the determined variables into the equations according to an aspect of the invention, so that four error variables $r_1$ to $r_4$ then result. The type of fault is then determined by way of predefined boundary value combinations. This too is effected automatically by way of the electronic data processing.

In an alternative further formation of the method according to the invention, for determining the type of fault, additionally to the two electrical variables, one may also determine two hydraulic variables, preferably by measurement, and compare the determined values to predefined values, wherein then in each case, the predefined values define a surface in three-dimensional space, and one determines as to whether the determined variables lie on these surfaces ($r_1$* to $r_4$*) or not, and on account of the combination of the values, one determines the type of fault by way of predefined boundary value combinations. The fault type may for example be determined for example by way of the following table:

| | fault variable | | | |
|---|---|---|---|---|
| | $r_1$, | $r_2$, | $r_3$, | $r_4$, |
| | comparative surface | | | |
| fault type | $r_1$* | $r_2$* | $r_3$* | $r_4$* |
| increased friction on account of mechanical defects | 1 | 0 | 1 | 1 |
| reduced delivery/ absent pressure | 0 | 1 | 1 | 1 |
| defect in suction region/absent delivery quantity | 1 | 1 | 0 | 1 |
| delivery stoppage | 1 | 1 | 1 | 1 |

It is therefore possible with the help of the method according to the invention to not only ascertain or not the fault-free operating condition of the pump assembly but also in the case of a fault, to specify this in detail with a minimum of sensor technology, so that a corresponding fault signal may be generated in the pump assembly, which displays the type of fault. This signal, as the case may be, may be transferred to distanced locations, where the function of the pump assembly is to be monitored.

The surfaces in the three-dimensional space which are formed by way of predefined values are typically spatially arcuate surfaces, whose values are previously determined at the factory on account of the respective assembly or assembly type, and on the part of the assembly are stored in the digital data memory. Thereby, the previously mentioned comparative surfaces $r_1$* to $r_4$* are arranged in a three-dimensional space, which at $r_1$*, are formed from the torque, the throughput and the rotor speed, at $r_2$* from the delivery head, the delivery quantity and the rotor speed, for $r_3$* from the torque, the delivery head and the rotor speed, as well as for $r_4$* from the torque, the delivery head and the delivery quantity.

The variables defined in the table by the comparative surfaces $r_1$* to $r_4$* characterize the respective operating condition, wherein the numeral 0 indicates that the respective value lies within the surface defined by the predefined values, and 1 that it lies outside this. Thus the fault combination defined in the table due to increased friction on account of mechanical defects may for example indicate bearing damage, or an increased friction resistance between the rotating parts and the stationary parts of the assembly, caused in any other manner. The fault combination characterized under the main term of reduced delivery/absent pressure may for example be caused by fault or wear of the pump impeller, or an obstacle in the pump inlet or outlet. The fault combination defined under the main term of defect in the suction region/absent delivery quantity may for example be caused by a defect of the ring seal at the suction port of the pump. The fault combination falling under the main term of delivery stoppage may have the most varied of causes and, as the case may be, is to be specified further. This delivery stoppage may be caused by a blocked shaft or a blocked pump impeller, by way of a failure of the shaft, by way of a detachment of the pump impeller, by way of cavitation on account of an unallowably low pressure at the pump inlet, as well as by way of running dry.

The operating conditions characterized in the table by way of the variables $r_1$ to $r_4$ are based on mathematical computations of fault variables $r_1$ to $r_4$ according to the equations (19) to (22), wherein the respective fault variable assumes the value zero when a perfect operation is present, and the value 1 in the case of a fault. The table with regard to the fault type is to be understood in a manner corresponding to that described above. Pictured, each of the fault variables $r_1$ to $r_4$ represents a distance to the respective surfaces $r_1$* to $r_4$*. However, the fault variables do not necessarily need to correspond with the surfaces $r_1$* to $r_4$*. The fault variables $r_1$ to $r_4$ correspond to the equations (19) to (22) and correspond to the surfaces $r_1$* to $r_4$* in the FIGS. 7 to 10.

In order to further differentiate the type of fault, in a further embodiment of the invention, it is envisaged to activate the pump assembly with a changed rotational speed on determining the fault, in order to then be able to pinpoint the determined fault in a closer manner on account of the measurement results which then set in.

Preferably the mechanical-hydraulic pump/motor model not only includes the pump assembly itself, but also at least parts of the hydraulic system which is affected by the pump, so that faults of this hydraulic system may also be determined.

Thereby, the hydraulic system is advantageously defined by the equation (18) which represents the change of the delivery flow over time.

$$K_J \frac{dQ}{dt} = H_p - (p_{out} + \rho g z_{out} - p_{in} - \rho g z_{in}) - (K_v + K_l)Q^2 \tag{18}$$

in which $K_J$ is the constant which describes the mass inertia of the fluid column in the pipe system, $K_V$ the constant which describes the flow-dependent pressure losses in the valve $K_L$, the constant which describes the flow-dependent pressure losses in the pipe system, Q the delivery flow of the pump $H_p$ the differential pressure of the pump, $P_{out}$ the pressure at the consumer-side end of the installation, $P_{in}$ the supply pressure, $Z_{out}$ the static pressure level at the consumer-side end of the installation, $Z_{in}$ the static pressure level at the pump entry, p the density of the delivery medium g the gravitational constant The fault variables $r_1$ to $r_4$ are advantageously defined by the equations (19) to (22):

$$\begin{cases} J\dfrac{d\hat{\omega}_1}{dt} = -B\hat{\omega}_1 - (-a_{t2}Q^2 + a_{t1}Q\omega + a_{t0}\omega^2) + T_e + k_e(\omega - \hat{\omega}_1) \\ r_1 = q_1(\omega - \hat{\omega}_1) \end{cases} \tag{19}$$

$$\{r_2 = q_2(-a_{h2}Q^2 + a_{h1}\omega Q + a_{h0}\omega^2 - H_p) \tag{20}$$

$$\begin{cases} Q' = \dfrac{a_{k1}\omega + \sqrt{a_{k2}^2\omega^2 - 4a_{k2}(H_p + a_{k0}\omega^2)}}{2a_{k2}} \\ J\dfrac{d\hat{\omega}_3}{dt} = -B\hat{\omega}_3 - (-a_{t2}Q'^2 + a_{t1}Q'\omega + a_{t0}\omega^2) + T_e + k_3(\omega - \hat{\omega}_3) \\ r_3 = q_3(\omega - \hat{\omega}_3) \end{cases} \tag{21}$$

$$\begin{cases} \omega' = \dfrac{-a_{h1}H_p + \sqrt{a_{h1}^2H_p^2 - 4a_{h2}(H_p + a_{h0}Q^2)}}{2a_{h2}} \\ J\dfrac{d\hat{\omega}_4}{dt} = -B\hat{\omega}_4 - (-a_{t2}Q^2 + a_{t1}Q\omega' + a_{t0}\omega'^2) + T_e + k_4(\omega' - \hat{\omega}_4) \\ r_4 = q_4(\omega' - \hat{\omega}_4) \end{cases} \tag{22}$$

in which $k_1$, $k_3$, $k_4$, represent constants, $q_1$, $q_2$, $q_3$, represent constants, $q_4$ Q' the computed delivery quantity on the basis of current rotational speed and measured pressure, $\hat{\omega}_1$ the computed rotor rotational speed on the basis of the mechanical-hydraulic equations (15) and (17), $\hat{\omega}_3$ the computed rotor rotational speed on the basis of the equations (15), (16) and (17), $\hat{\omega}_4$ the computed rotor rotational speed on the basis of the measured delivery pressure and measured delivery quantity ω' the computed rotor rotational speed on the basis of the measured delivery pressure and measured delivery quantity $r_1$-$r_4$ fault variables, and $r_1$*-$r_4$* surfaces determined by three variables, which represent a fault-free operation of the pump.

In order to carry out the inventive method for determining faults with operational conditions of a centrifugal pump assembly, there, means are provided for detecting two electrical variables determining the power of the motor, as well as means for detecting at least one changing hydraulic variable of the pump, as well as an electronic evaluation means which determines a fault condition of the pump assembly on account of the detected variables. In its simplest form, here sensor means for detecting the supply voltage present at the motor and the supply current as well as for detecting the pressure, preferably differential pressure produced by the pump, and the delivery quantity or the rotational speed are to be provided. Furthermore, an evaluation means is to be provided, which may be designed in the form of a digital data processing, e.g. a microprocessor, in which the method according to the invention may be implemented with regard to software. An electronic memory is further to be provided in order to be able carry out the comparison between detected or computed values and predefined values (e.g. detected and stored on the part of the factory). With modern pump assemblies controlled by frequency converter, all the previous preconditions with regard to hardware are already present, so that one must only ensure an adequate dimensioning of the electronic data processing installation, in particular of the memory means and the evaluation means. All components with the exception of the sensor system required for the detection of the hydraulic variables are preferably an integral component of the motor electronics and/or pump electronics, so that inasmuch as concerned, constructively no further provisions are to be made for implementing the method according to the invention. Another embodiment form may be a separate component to be provided in a switch panel or control panel, in the same manner as a motor circuit breaker, but with the monitoring and diagnosis properties as described above.

The embodiment forms described here relate to centrifugal pumps, as this also results from the mechanical-hydraulic pump model. Such pumps may for example be industrial pumps, submersible pumps for the sewage or for the water supply, as well as heating circulation pumps. A diagnosis system according to the invention is particularly advantageous with canned motor pumps, since as a precaution, one may prevent the grinding-through of the can and thus the exit of delivery fluid, e.g. into the living rooms by way of the early fault recognition. On application of the invention in the field of displacement pumps, the mechanical-hydraulic pump model must be adapted according to the differing physical relationships. The same also applies to the electrical motor model with the application of other motor types.

Furthermore, according to the invention, means are provided in order to produce at least one fault notification and to transit it to a display element which is arranged on the pump assembly or somewhere else, be it in the form of one or more control lights, or of a display with an alpha-numeric display. Thereby, the transmission may be effected in wireless manner, for example via infrared or radio, or also be connected by wire, preferably in a digital form.

The method according to the invention is shown in its simplified form by way of FIG. 1. The changing electrical variables determining the power, here, in particular the voltage $V_{abc}$ and the current $i_{abc}$ flow into an electrical motor model. The product of these variables defines the electrical power taken up by the motor. The torque $T_e$ at the shaft of the motor as well as the rotational speed co of the motor, as result numerically on account of the motor model, may be deduced from this motor model as is given for example by the equations (1) to (5) or (6) to (9) or (10) to (14). These electrical variables of the motor which are dependent on the power are linked with the determined mechanical delivery head H (pressure) in a pump model 2, for example according to the equations (16) and (17), wherein then the result is compared with operational values which are determined and predefined by way of defined operating points. The pump assembly operates without faults on agreement of these input variables with the predefined values. If however a difference beyond a certain measure results, then an error signal r is generated, which signalizes a faulty function of the pump.

Figure 2:
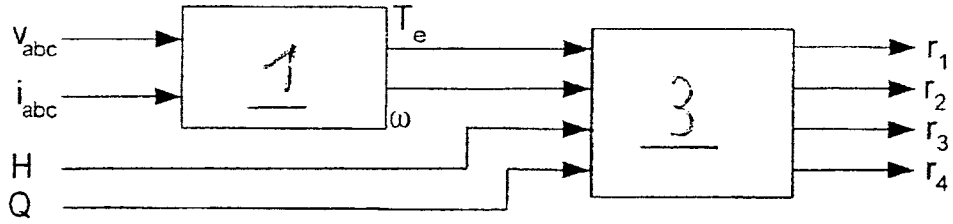
FIG. 2 is a schematic view of a second method embodiment according to the invention.

With the embodiment according to FIG. 2, in the same manner as with FIG. 1, the input voltage $V_{abc}$ and the motor current $i_{abc}$ are used as input values for the motor model 1, in order to determine the torque $T_e$ prevailing at the motor shaft and the rotational speed of the shaft ω. These values derived from the motor model 1, as well as the variables of the delivery head H (pressure) as well as delivery quantity Q determined by sensor are mathematically linked to one another in a mechanical-hydraulic pump model 3, which e.g. is formed further by the equations (19) to (22). Here, four error variables $r_1$ to $r_4$ are generated, wherein a fault-free operation is present when these all assume the value zero and thus the operating points lie in the surfaces $r_1$* to $r_4$* represented individually in the FIGS. 7 to 10. These surfaces represented there are defined by a multitude of operating points on envisaged proper operation of the pump assembly, and are produced on the part of the factory and are digitally stored in memory component of the evaluation electronics. Alternatively or additionally, it is ascertained whether the error variables $r_1$ to $r_4$ determined on account of the mechanical-hydraulic pump model are zero or not, and an evaluation according to the previously described table is effected according to this result. Depending on whether an error variable is present or not on occurrence of a fault, as a whole four erroneous operating conditions of the pump assembly may be ascertained, and specifically, those falling under the previously mentioned terms:

1. increased friction on account of a mechanical defect,
2. reduced delivery/absent pressure,
3. defect in the suction region/absent delivery quantity, and
4. delivery stoppage.

Figure 4:
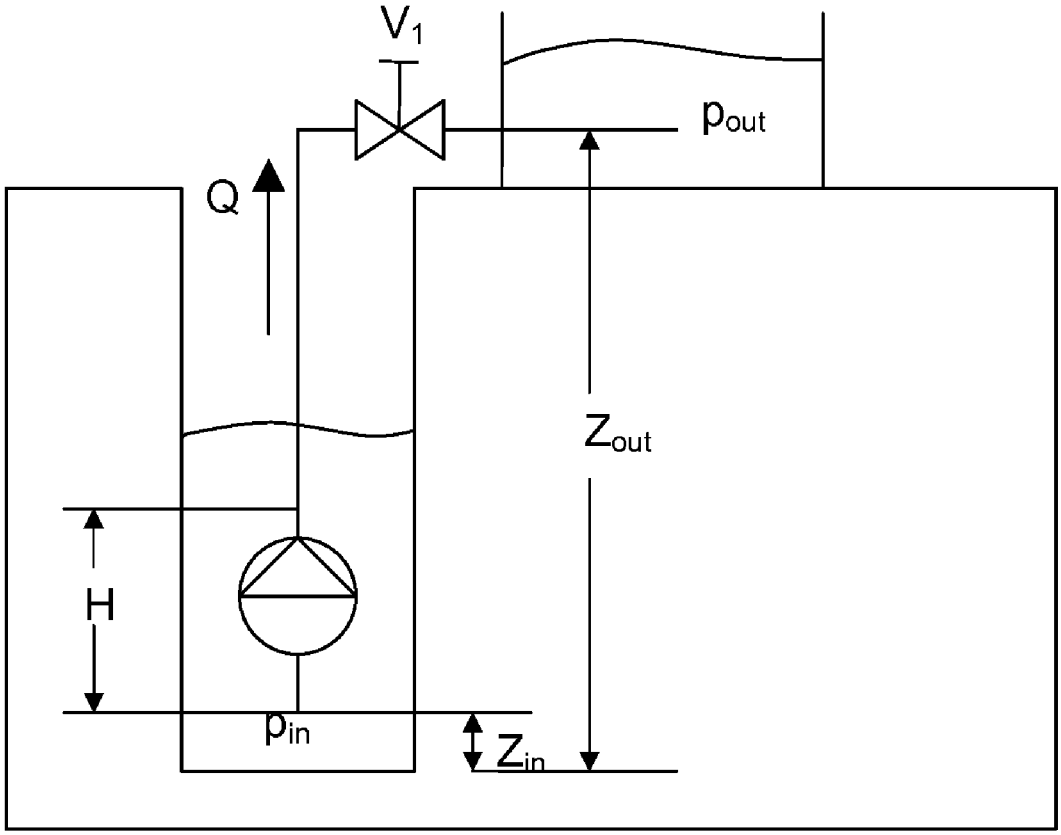
FIG. 4 is a schematic sectional view of a hydraulic installation with which the method according to the invention may be applied.
Figure 5:
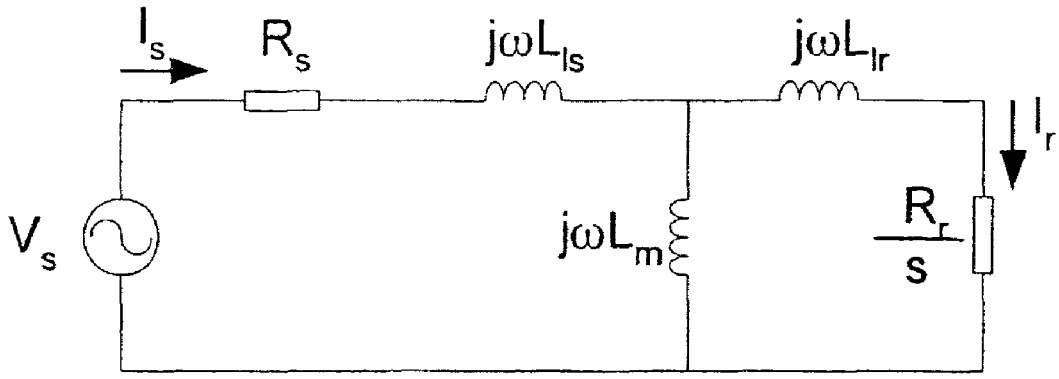
FIG. 5 is a circuit representation of a motor model.

With the method according to the invention, one may not only monitor the pump assembly itself, but also parts of the installation in which the pump assembly is arranged may be monitored. Thereby, the system is broken down as is shown in detail in FIG. 3. Here too, an electrical motor model is provided, whose input variables are $V_{abc}$ and $i_{abc}$, and on which a static motor model according to the equations (6) to (9) is based, such as has been known until now and is represented by way of FIG. 5. The output variable of this static motor model is the motor moment $T_e$, which in turn flows into the mechanical part of the pump model 3*a* via the equation (15). The hydraulic part of the pump model 3*b* is defined by the equations (16) and (17), via which the hydraulic part of the installation 4 is coupled. The hydraulic part of the installation is defined by the equation (18) and is schematically represented by way of FIG. 4, in which $P_{in}$ represents the pressure supply of the pump, $H_p$ the differential pressure of the pump, Q the delivery flow, $P_{out}$ the pressure at the consumer-side end of the installation and $V_1$ the flow losses within the pump. $Z_{out}$ is the static pressure level at the consumer side end of the installation and $Z_{in}$ that at the pump entry.

Figure 3:
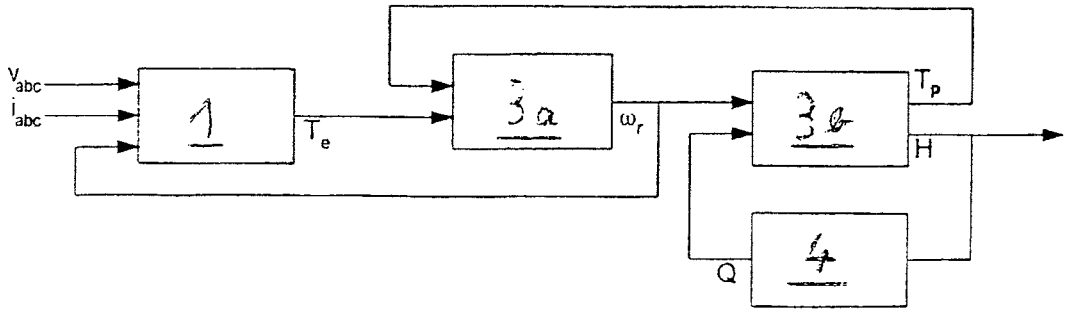
FIG. 3 is a schematic view of a third method embodiment according to the invention.

FIG. 3 thus emphasizes the relationships between the motor model, the mechanical part of the pump model, the hydraulic part of the pump model and the hydraulic part of the installation. Whereas the delivery head and the delivery quantity enter and exit in and out of the hydraulic parts of the pump model 3*b* and the hydraulic part of the installation, the rotational speed $\omega_r$ which also enters into the motor model, enters into the hydraulic part of the pump model 3*b*. The moment evaluated from the hydraulic part of the pump model 3*b* in turn enters into the mechanical part of the pump model 3*a* for determining the rotational speed.

The previously described equations for the mathematical description of the pump and motor are only to be understood by way of example and may, as the case may be replaced by other suitable equations as are known from the relevant technical literature. The above faults which may be determined with these models on operation of a pump assembly, or the differentiation according to fault types may be further diversified by way of suitable fault algorithms.

Figure 6:
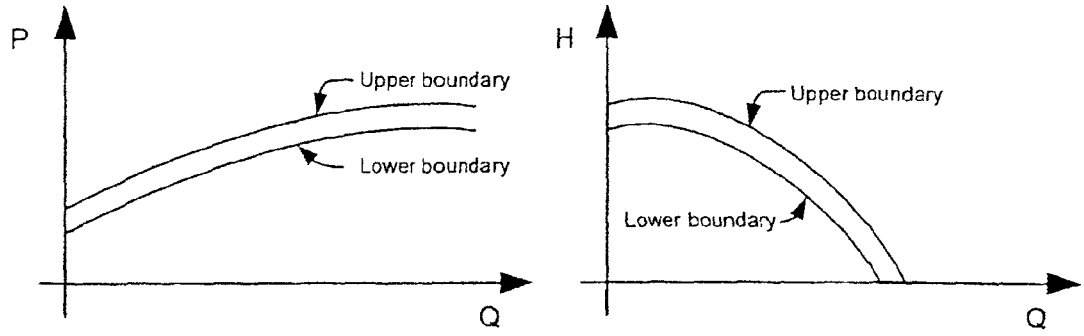
FIG. 6 is a view of graphs with the power plotted against the delivery quantity on the left and the delivery head plotted against the delivery quantity on the right.
Figure 7:
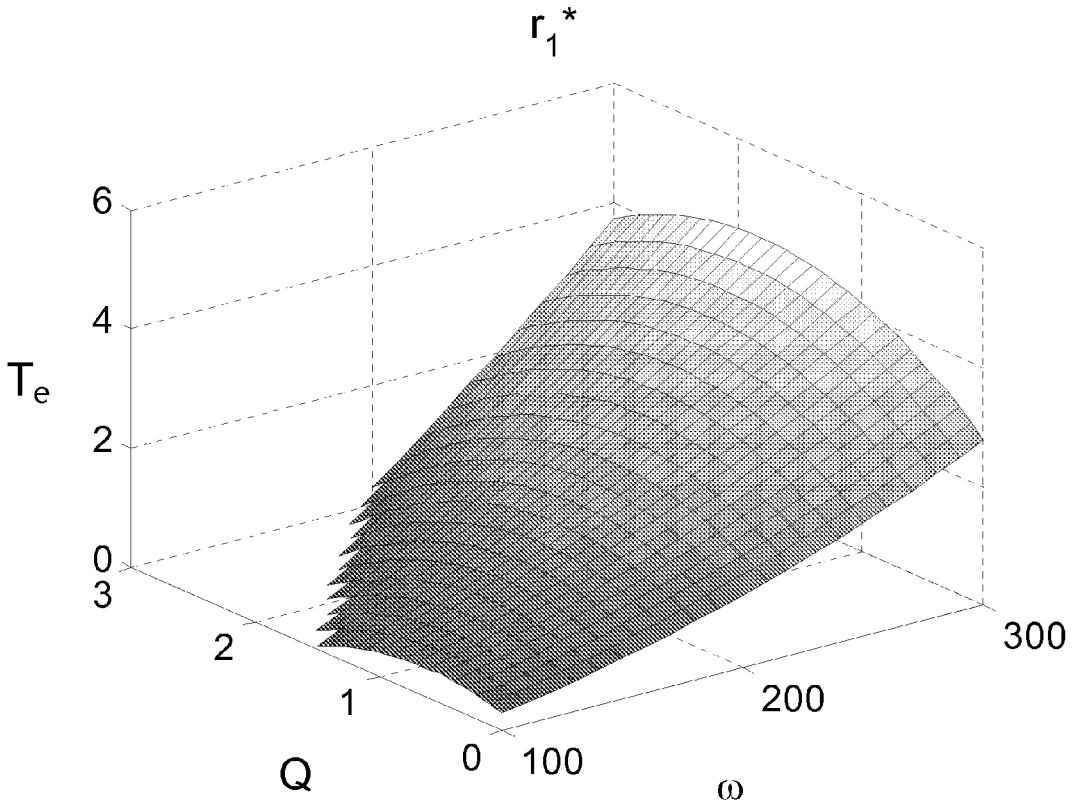
FIG. 7 is a graph of surface $r_1$* defined by a multitude of operating points.
Figure 8:
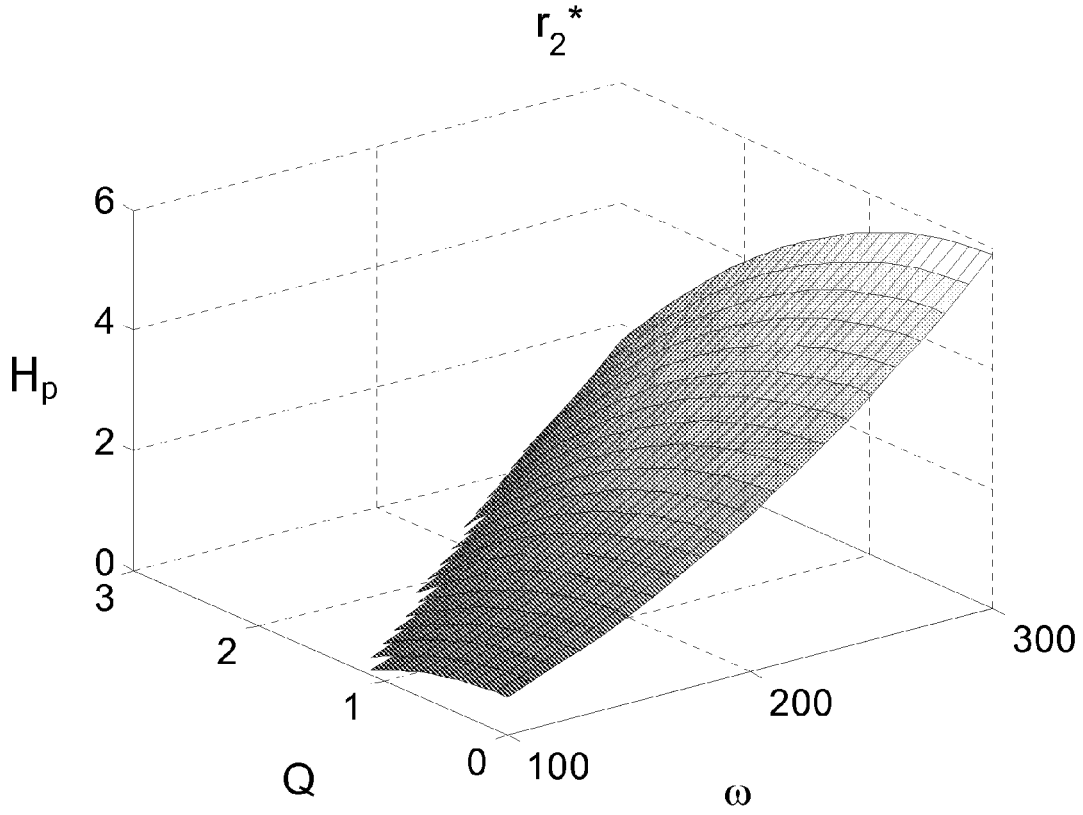
FIG. 8 is a graph of surface $r_2$* defined by a multitude of operating points.
Figure 9:
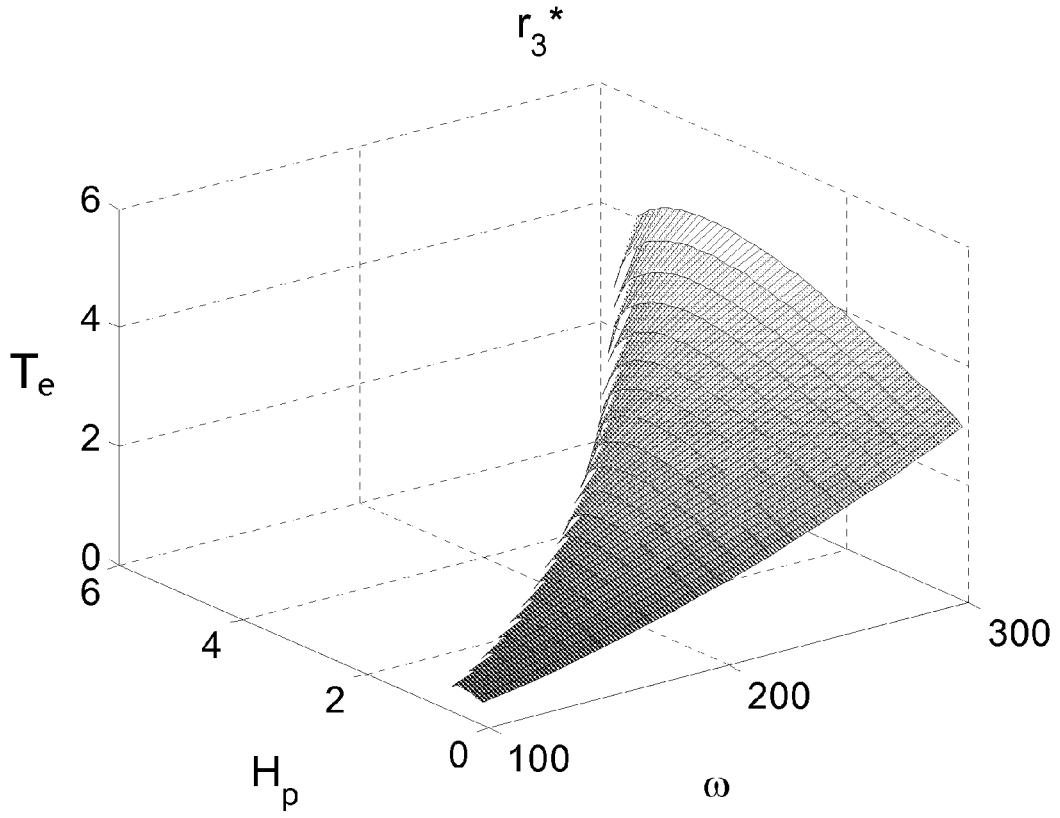
FIG. 9 is a graph of surface $r_3$* defined by a multitude of operating points.
Figure 10:
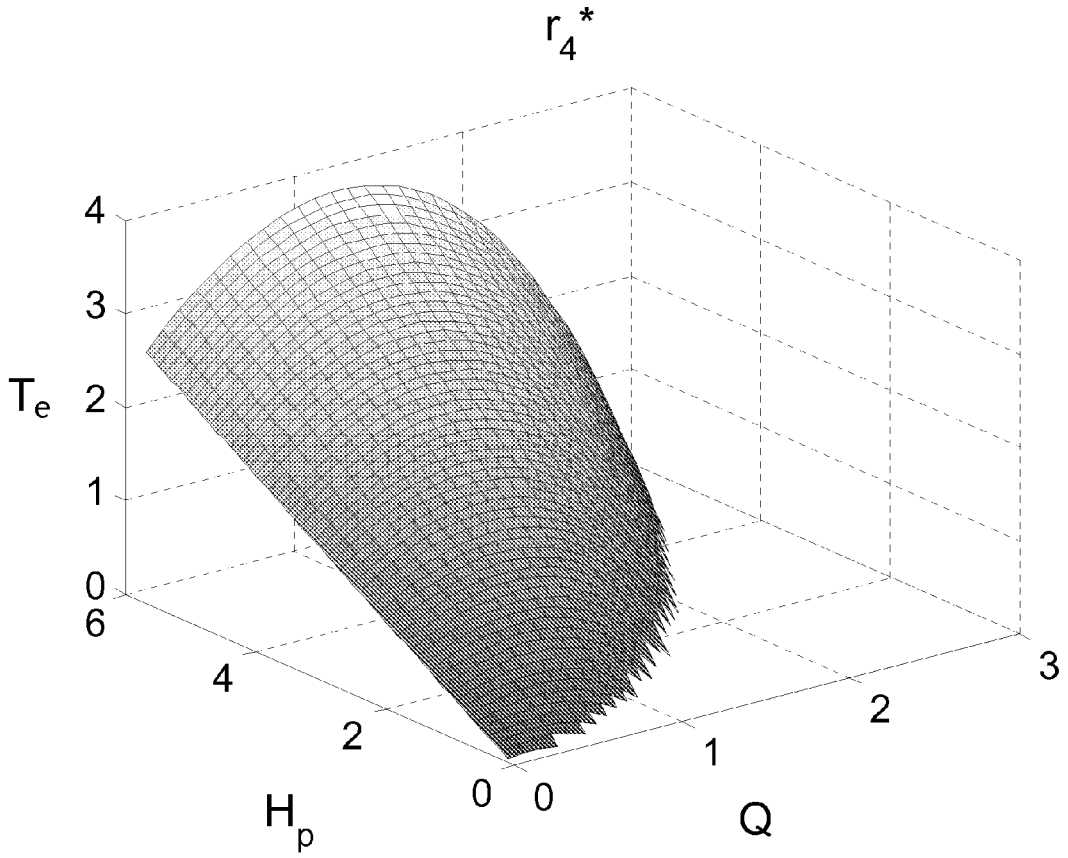
FIG. 10 is a graph of surface $r_4$* defined by a multitude of operating points.

In order to ensure that already small manufacturing tolerances or measurement errors do not lead to the issuing of fault signals, it is useful not to select the parameters $a_n$ and $a_t$ specified in the equations (16) and (17) in a constant manner, but in each case to fix a lower or upper boundary value in order to produce a certain bandwidth, as is shown in FIG. 6. In the left curve shown there, the power is plotted against the delivery quantity, and in the right curve, the delivery head is plotted against the delivery quantity.

While a specific embodiment of the invention has been shown and described in detail to illustrate the application of the principles of the invention, it will be understood that the invention may be embodied otherwise without departing from such principles.

What is claimed is:

1. A method for determining faults on operation of a pump assembly, the method comprising the steps of:

providing the pump assembly with a pump motor with at least two electrical variables of the motor determining an electrical power of the motor, and a pump having at least two changing hydraulic variables;

providing an electrical detection means for detecting the electrical variables of the motor;

providing a hydraulic detection means for detecting the changing hydraulic variables of the pump;

detecting the electrical variables of the motor with the electrical detection means;

detecting the hydraulic variables of the pump with the hydraulic detection means;

providing a mathematical electrical motor model for generating a motor value from a mathematical linking of the detected electrical variables of the motor;

generating the motor value by input of the detected electrical variables of the motor into the mathematical electrical motor model;

providing a mathematical mechanical-hydraulic pump model for generating a pump comparison value from a mathematical linking of the motor value and the detected hydraulic variables of the pump;

generating the pump comparison value by input of the motor value and the detected hydraulic variables of the pump into the mathematical mechanical-hydraulic pump model;

providing a predefined pump value;

comparing the pump comparison value to the predefined pump value to detect an agreement or a difference between the pump comparison value and the predefined pump value; and generating an error signal upon determining a fault based on detecting a difference between the pump comparison value and the predefined pump value beyond a threshold to indicate a faulty function of the pump, wherein:

the two electrical variables of the motor which determine the electrical power of the motor, are a voltage prevailing at the motor and a current feeding the motor; and the two detected hydraulic variables are each one of a pressure produced by the pump, a delivery quantity of the pump and a differential pressure between a suction side and a pressure side of the pump.

2. The method according to claim 1, wherein after generating the error signal, determining a faulty function of the pump which caused the generating of the error signal.

3. A method according to claim 1, wherein upon determining the fault, the pump assembly is activated with a changed rotational speed, according to the measurement results which specify the determined fault.

4. The method according to claim 1, wherein the mechanical-hydraulic pump/motor model also includes at least parts of the hydraulic system affected by the pump, in a manner such that faults of the hydraulic system may also be determined.

5. The method according to claim 1, wherein using predefined values of the two electrical variables and two hydraulic variables to define a surface for each of the predefined values of the two electrical variables and two hydraulic variables;

upon determining the fault, the determined values for the two electrical variables and the two hydraulic variables are compared to the defined surfaces to determines whether the determined variables or those derived therefrom lie on one of these surfaces or not, and a type of fault is determined by way of a combination of fault variables and by way of predefined boundary value combinations.

6. A method for determining faults on operation of a pump assembly, the method comprising the steps of:

providing the pump assembly with a pump motor with at least two electrical variables of the motor determining an electrical power of the motor, and a pump having at least two changing hydraulic variables;

providing an electrical detection means for detecting the electrical variables of the motor;

providing a hydraulic detection means for detecting the changing hydraulic variables of the pump;

detecting the electrical variables of the motor with the electrical detection means;

detecting the hydraulic variables of the pump with the hydraulic detection means;

providing a mathematical electrical motor model for generating a motor value from a mathematical linking of the detected electrical variables of the motor;

generating the motor value by input of the detected electrical variables of the motor into the mathematical electrical motor model;

providing a mathematical mechanical-hydraulic pump model for generating a pump comparison value from a mathematical linking of the motor value and the detected hydraulic variables of the pump;

generating the pump comparison value by input of the motor value and the detected hydraulic variables of the pump into the mathematical mechanical-hydraulic pump model;

providing a predefined pump value;

comparing the pump comparison value to the predefined pump value to direct an agreement or a difference between the pump comparison value and the predefined pump value;

generating an error signal upon determining a fault based on detecting a difference between the pump comparison value and the predefined pump value beyond a threshold to indicate a faulty function of the pump; and wherein on determining the fault, the pump assembly is activated with a changed rotational speed, according to the measurement results which specify the determined fault.

7. The method according to claim 6, wherein:

the two electrical variables of the motor which determine the electrical power of the motor, are a voltage prevailing at the motor and a current feeding the motor; and the detected hydraulic variables each one of a pressure produced by the pump, a delivery quantity of the pump and a differential pressure between a suction side and a pressure side of the pump.

8. The method according to claim 6, wherein after generating the error signal, determining what faulty function of the pump caused the generating of the error signal.

9. The method according to claim 6, wherein the mechanical-hydraulic pump/motor model also includes characteristics of the hydraulic system affected by the pump, in a manner such that faults of the hydraulic system may also be determined.

10. The method according to claim 6, further comprising:

using predefined values of the two electrical variables and two hydraulic variables to define a surface for each of the predefined values of the two electrical variables and two hydraulic variables;

upon determining the fault, the determined values for the two electrical variables and the two hydraulic variables are compared to the defined surfaces to determine whether the determined variables or those derived therefrom lie on one of said defined surfaces or not, and a type of fault is determined by way of a combination of fault variables and by way of predefined boundary value combinations.

11. A method for determining faults on operation of a pump assembly, the method comprising the steps of:

measuring a voltage prevailing at a motor and a current feeding the motor as two electrical variables of the motor which determine an electrical power of the motor;

measuring at least one changing hydraulic variable of a pump, wherein the detected hydraulic variable is one of a pressure produced by the pump, a delivery quantity of the pump and a differential pressure between a suction side and a pressure side of the pump;

measuring at least one further mechanical or hydraulic variable which determines the power of the pump;

mathematically linking the two electrical variables of the motor which determine the electrical power of the motor for providing at least one comparison value;

mathematically linking the at least one changing hydraulic variable of the pump, as well as the at least one further mechanical or hydraulic variable determining the power of the pump for providing at least one pump comparison value, wherein a mathematical electrical motor model is used in combination with a mathematical mechanical-hydraulic pump model/motor model for the mathematical linking steps;

comparing the results of the mathematical linking steps with at least one predefined value; and generating an error signal upon detecting a difference between the results of the mathematical linking steps and the at least one predefined value, which difference is beyond a threshold, to indicate a faulty function of the pump.

12. The method according to claim 11, wherein after generating the error signal, determining a faulty function of the pump which caused the generating of the error signal.

13. The method according to claim 11, wherein on determining the fault, the pump assembly is activated with a changed rotational speed, according to the measurement results which specify the determined fault.

14. The method according to claim 11, wherein the mechanical-hydraulic pump/motor model also includes characteristics of the hydraulic system affected by the pump, in a manner such that faults of the hydraulic system may also be determined.

15. The method according to claim 11, wherein measuring the at least one further mechanical or hydraulic variable includes determining an additional hydraulic variable by measurement such that said two electrical variables and two hydraulic variables are determined by way of measurement;

using predefined values of the two electrical variables and two hydraulic variables to define a surface for each of the predefined values of the two electrical variables and two hydraulic variables;

upon determining the fault, the determined values for the two electrical variables and the two hydraulic variables are compared to the defined surfaces to determines whether the determined variables or those derived therefrom lie on one of said defined surfaces or not, and a type of fault is determined by way of a combination of fault variables and by way of predefined boundary value combinations.

* * * * *